United States Patent [19]

Ronca

[11] 4,168,648

[45] Sep. 25, 1979

[54] CAPOTASTO

[76] Inventor: Carl Ronca, Habsburgerstrasse 35, 6003 Lucerne, Switzerland

[21] Appl. No.: 857,592

[22] Filed: Dec. 5, 1977

[30] Foreign Application Priority Data

Dec. 16, 1976 [CH] Switzerland ..... 15975/76

[51] Int. Cl.[2] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 390,612 | 10/1888 | Moffat | 84/318 |
| 4,048,894 | 9/1977 | Myerson | 84/318 |

*Primary Examiner*—L. T. Hix

*Assistant Examiner*—S. D. Schreyer

*Attorney, Agent, or Firm*—Werner W. Kleeman

[57] ABSTRACT

An open capotasto essentially comprising a substantially U-shaped, metallic bracket, one leg of which is provided with a string depressor cushion or pad and the other leg of which with a clamping or tightening device. Both legs of the bracket can be resiliently spread away from one another. One of the legs and part of the yoke of the bracket are surrounded by a sleeve formed of compressible material and forming the string depressor cushion or pad. At the region of the yoke this sleeve possesses a projection or extension which protrudes in the direction of the clamping or tightening device, the latter of which is effective in its clamping action through such projection. The clamping device can be in the form of an eccentric or clamping lever.

6 Claims, 5 Drawing Figures

CAPOTASTO

BACKGROUND OF THE INVENTION

The present invention relates to a new and improved construction of capotasto which is of the type comprising a substantially U-shaped, metallic bracket, one leg of which is equipped with a string depressor cushion or pad and the other leg of which is provided with a clamping or tightening device intended to engage at the underside of the neck of the related instrument. The invention thus is concerned with a so-called "open" capotasto.

Apart from the so-called "closed" capotastos, i.e., those where they completely enclose the neck of the stringed instrument, for instance a guitar, lute, banjo or the like, there are also known to the art capotastos of the previously mentioned type. Such are constructed in the manner of a screw-clamp, wherein the pressure leg, located opposite the clamping device constructed as a threaded spindle, is provided with a string depressor cushion or pad. Upon tightening the threaded spindle such engages essentially at a comparatively small surface or area of the underside of the neck of the instrument and which underside, as a general rule, is usually of convex configuration. If with the heretofore known capotasto it is desired to fixedly clamp all of the strings extending over the finger or fret board, then it is necessary, prior to tightening the threaded spindle, to manually press the leg equipped with the string depressor cushion into the desired position at the finger board and then to still shift such transversely with respect to the instrument neck or finger board, in order that the threaded spindle approximately engages at that location of the underside of the instrument neck where the tangential plane extends parallel to the plane of the finger board.

Even with these cumbersome manipulations the state-of-the-art capotasto nonetheless does not provide any assurance that during playing of the instrument it will not tilt about the lengthwise axis of the neck, so that the clamping action at a part of the strings is lost. Furthermore, the prior art capotasto gets in the way of the hand of the user of the instrument.

SUMMARY OF THE INVENTION

Hence, with the foregoing in mind it is a primary object of the present invention to provide a new and improved construction of capotasto which is not associated with the aforementioned drawbacks and limitations of the prior art proposals.

Another and more specific object of the present invention is directed to providing a capotasto of the previously mentioned type, which not only can be simply and rapidly handled, but also ensures for a positive clamping of all of the engaged strings of the instruments, and furthermore, can be simply and attractively fabricated.

Now in order to implement these and still further objects of the invention, which will become more readily apparent as the invention proceeds, the capotasto of the present development is manifested by the features that the one leg is surrounded by a sleeve or envelope formed of compressible material and forming the string depressor cushion or pad. This sleeve or envelope, at the region of the yoke of the bracket, has a flexible extension or projection which is directed towards the clamping device, and the clamping device, in turn, exerts its clamping action by means of such projection.

The clamping device advantageously comprises an eccentric lever, which, when tightened, has its handle bearing against the related leg.

The sleeve or envelope and the clamping lever can be fabricated of plastic, wherein, however, the plastic of the sleeve should be softer, i.e., more compressible, than the plastic of the clamping or tightening lever.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1A:
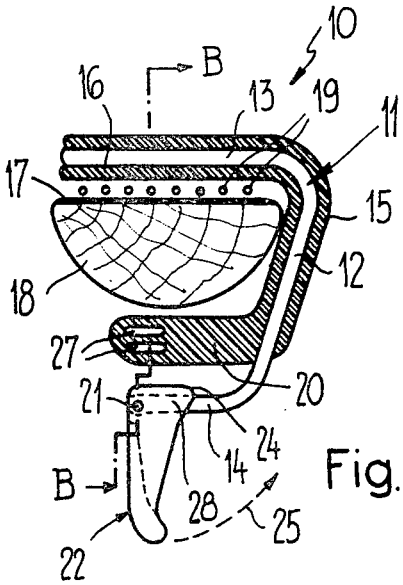
FIG. 1*a* is a sectional view transversely through the neck of a stringed instrument, for instance a guitar, and through the capotasto of the invention shown in its untightened position, the section being taken approximately along the line A—A of FIG. 1*b;*

Turning attention now to the drawings, it is firstly to be understood that the drawings are not to be construed as particularly illustrating the capotasto to scale. The illustrated exemplary embodiment of capotasto 10, as shown in FIGS. 1*a,* 1*b,* 2*a* and 2*b,* will be seen to comprise a metallic, essentially U-shaped bracket 11, preferably formed of spring steel, having a yoke 12 and at both ends thereof legs 13 and 14 which merge therewith. The bracket 11 preferably has the same cross-sectional shape, here shown to be substantially circular by way of example, over its entire length. The leg 13 and a part of the yoke 12 are enclosed by a hose-like sleeve or envelope 15 formed of a soft, i.e., compressible plastic. The part 16 of the sleeve or envelope 15 which is seated on the leg or leg portion 13, and located opposite the other leg or leg portion 14, forms the clamping cushion or pad for the strings 19 of the stringed instrument, for instance a guitar or lute, and which strings 19 usually extend at a slight spacing over the finger or fret board 17 at the neck 18 of the instrument. The envelope or sleeve 15 has a projection or extension 20 which is formed at the region of the yoke, this projection 20 extending approximately parallel to the leg 14.

Continuing, means for clamping the capotasto to the fret board 17 at the neck 18 of the stringed instrument are provided. To that end, in the embodiment shown, there is hingedly connected at the end of the leg 14 by means of the hinge or pivot pin 21 a clamping element, here shown as an eccentric or clamping lever 22. As best seen by referring to FIGS. 1*b* and 2*b* the clamping or tightening lever 22 has an essentially U-shaped configuration and at both of its flanks which straddle the leg 14 possesses a respective cam 23 and 24 or equivalent structure. The end region of the projection or extension 20 is disposed between the clamping lever 22 and the leg 13.

Figure 1B:
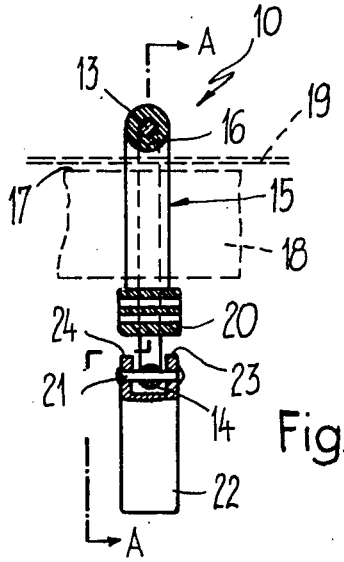
FIG. 1*b* is a sectional view, substantially along the line B—B of FIG. 1*a,* showing the capotasto in its untightened position.
Figure 2A:
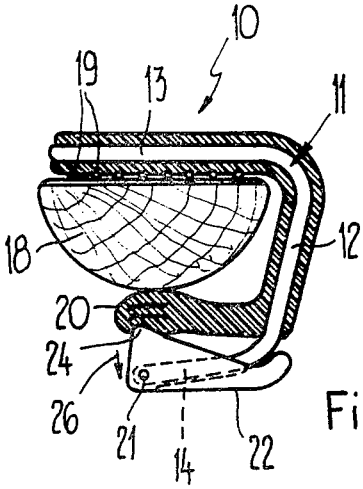
FIG. 2*a* is a sectional view, like the showing of FIG. 1*a*, but this time illustrating the capotasto in its clamped position.
Figure 2B:
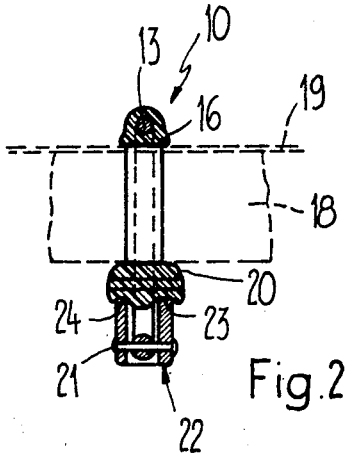
FIG. 2*b* is a sectional view, corresponding to the showing of FIG. 1*b,* illustrating the capotasto in its clamped or tightened position.

FIGS. 1*a* and 1*b*, as mentioned, illustrated the capotasto 10 mounted but not yet tightened at the stringed instrument. Now if the clamping or tightening lever 22 is rocked in the direction of the arrow 25 of FIG. 1*a*, then the cams 23 and 24 come into engagement with the end region of the projection 20 and push such against the underside of the instrument neck 18. As soon as the apex or raised portion of the cams 23 and 24 has passed the pivot axis defined by the pin 21 of the lever 22, there is then reached a stable clamping or tightening position. As a result, also the leg 13 together with the string depressor cushion or pad 16 is pressed against the finger board 17 and the strings 19 of the instrument, and, as best seen by referring to FIGS. 2*a* and 2*b*, the string depressor or depression cushion 16, while deforming snugly bears at the strings 19. Also the projection 20 experiences a deformation at least at its end region, so that such flatly bears against the underside of the neck 18. Since the legs 13 and 14 can be spread resiliently away from one another, during clamping of the capotasto 10 the leg 14 is bent somewhat in the direction of the arrow 26 of FIG. 2*a*. As a result, the leg 13 together with the string depressor cushion or pad 16 bears at the region of its free end with a somewhat greater force against the strings 19 than at the region of the yoke 12.

The described capotasto 10 is not only very simple to manipulate and handle and positive in its operation, but additionally also affords the advantage that it is practically impossible that a hard part, namely the bracket 11 or the clamping lever 22, can come into direct contact with the neck 18, which as a general rule is formed of lacquered or varnished wood, or the strings 19. The envelope or sleeve 15 together with its projection 20 therefore also provides a certain protective function.

In order to increase the compressibility of the projection 20 and also the force exerting or compression action of the cams 23 and 24, it is possible as indicated in FIG. 1a, to provide cut-outs or openings 27 and 28 at the projection 20 and/or in each of the cams 23, 24 respectively. In this way it is possible to broaden the field of use of the capotasto 10 so as to enable use thereof with stringed instruments which differ as to the thickness of their neck.

As can be particularly seen by referring to FIG. 1b, the part 16 of the envelope or sleeve 15 which forms the string clamping cushion or pad advantageously can have a greater wall thickness than the remaining part of such envelope 15 with the exception of the projection 20.

Figure 3:
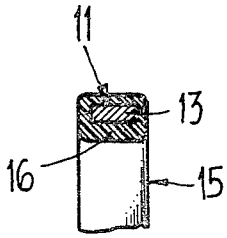
FIG. 3 is a fragmentary sectional view through the leg of another embodiment of capotasto wherein the bracket has a different cross-sectional shape.

Finally, in FIG. 3 there is shown a sectional view through the leg 13 of a variant embodiment, which differs from that heretofore described, by virtue of the cross-sectional shape of the bracket 11 being essentially rectangular, so that the bracket 11 functions in the manner of a blade or leaf spring clamp which is encased over part of its length. This cross-sectional shape enables a further spreading of the legs 13 and 14 away from one another without overloading or over-expanding the material of the bracket, and additionally, increases the stability of the capotasto inasmuch as upon fixedly clamping such it always comes to lie in a plane extending at right angles to the lengthwise extent of the neck 18 of the instrument.

While there are shown and described present preferred embodiments of the invention it is to be distinctly understood that the invention is not limited thereto, but may be otherwise variously embodied and practiced within the scope of the following claims. ACCORDINGLY,

What I claim is:

1. A capotasto for a stringed instrument having a neck over which extend the strings, comprising:

a substantially U-shaped, resilient metallic bracket having an intermediate yoke and legs extending from opposite ends of said yoke, both of said legs of said bracket being resiliently spreadable away from one another, a sheath member of a compressible material snugly surrounding one of said legs and an adjoining portion of said yoke, said sheath member having a flexible projection extending from said yoke and between said legs, a clamping lever including a cam member, means for pivotably mounting said clamping lever at the end of the other leg, said mounting means defining a pivot axis extending transversely with respect to said other leg, said flexible projection extending over said cam member, said clamping lever exerting its clamping action via said flexible projection, whereby the legs of the metallic bracket are spread apart and the sheath member surrounding said one leg is compressed to an extent corresponding substantially to the diameter of the strings.

2. The capotasto as defined in claim 1, wherein:

said clamping lever includes a pair of cams;

each cam being disposed to one respective side of said other leg and extending in the direction of said projection.

3. The capotasto as defined in claim 1, wherein:

said bracket is formed of spring steel and possesses essentially the same cross-sectional shape over its entire length.

4. The capotasto as defined in claim 3, wherein:

said cross-sectional shape is substantially round.

5. The capotasto as defined in claim 3, wherein:

said cross-sectional shape is substantially rectangular, whereby said bracket possesses the shape of a leaf spring clamp.

6. The capotasto as defined in claim 2, wherein:

said pair of cams have an apex means for reaching a stable clamping position upon passing the pivot axis.

* * * * *